United States Patent [19]

Brown et al.

[11] 4,120,449

[45] Oct. 17, 1978

[54] CENTRIFUGAL PROCESSING APPARATUS USING TUBE DRIVE

[75] Inventors: Richard I. Brown, Northbrook; Daniel R. Boggs, Vernon Hills, both of Ill.

[73] Assignee: Baxter Travenol Laboratories, Inc., Deerfield, Ill.

[21] Appl. No.: 805,952

[22] Filed: Jun. 13, 1977

[51] Int. Cl.[2] ..... B04B 9/00

[52] U.S. Cl. ..... 233/23 R

[58] Field of Search ..... 233/1 R, 23 R, 24, 25, 233/26; 74/797; 260/75 R; 64/2 R, 1 S

[56] References Cited

U.S. PATENT DOCUMENTS

| | | | |
|---|---|---|---|
| 3,775,373 | 11/1973 | Wolfe | 260/75 R |
| 3,784,520 | 11/1974 | Hoeschele | 260/75 R |
| 3,954,689 | 5/1976 | Hoeschele | 260/75 R |
| 3,986,442 | 10/1976 | Khoja et al. | 74/797 |
| 4,056,224 | 11/1977 | Lolachi | 233/26 X |

*Primary Examiner*—George H. Krizmanich
*Attorney, Agent, or Firm*—Henry W. Collins; Paul C. Flattery; George H. Gerstman

[57] ABSTRACT

Centrifugal processing apparatus in which a processing chamber is rotatably mounted with respect to a stationary base. An umbilical cable segment formed of tubular material is fixed at one end substantially along the axis of the processing chamber at one side thereof, with the other end of the cable segment being attached substantially on the axis in rotationally locked engagement to the processing chamber. The tubular material has a dynamic stiffness of between 0.1 in.$^2$ pounds and 100 in.$^2$ pounds. The cable segment is driven by an enclosure carrying a drive pin and rotated by a drive shaft. The processing chamber forms an idling member which follows only the driving rotation of the cable segment to rotate at twice the speed of the cable segment without the need for any external drive.

7 Claims, 2 Drawing Figures

FIG. 1
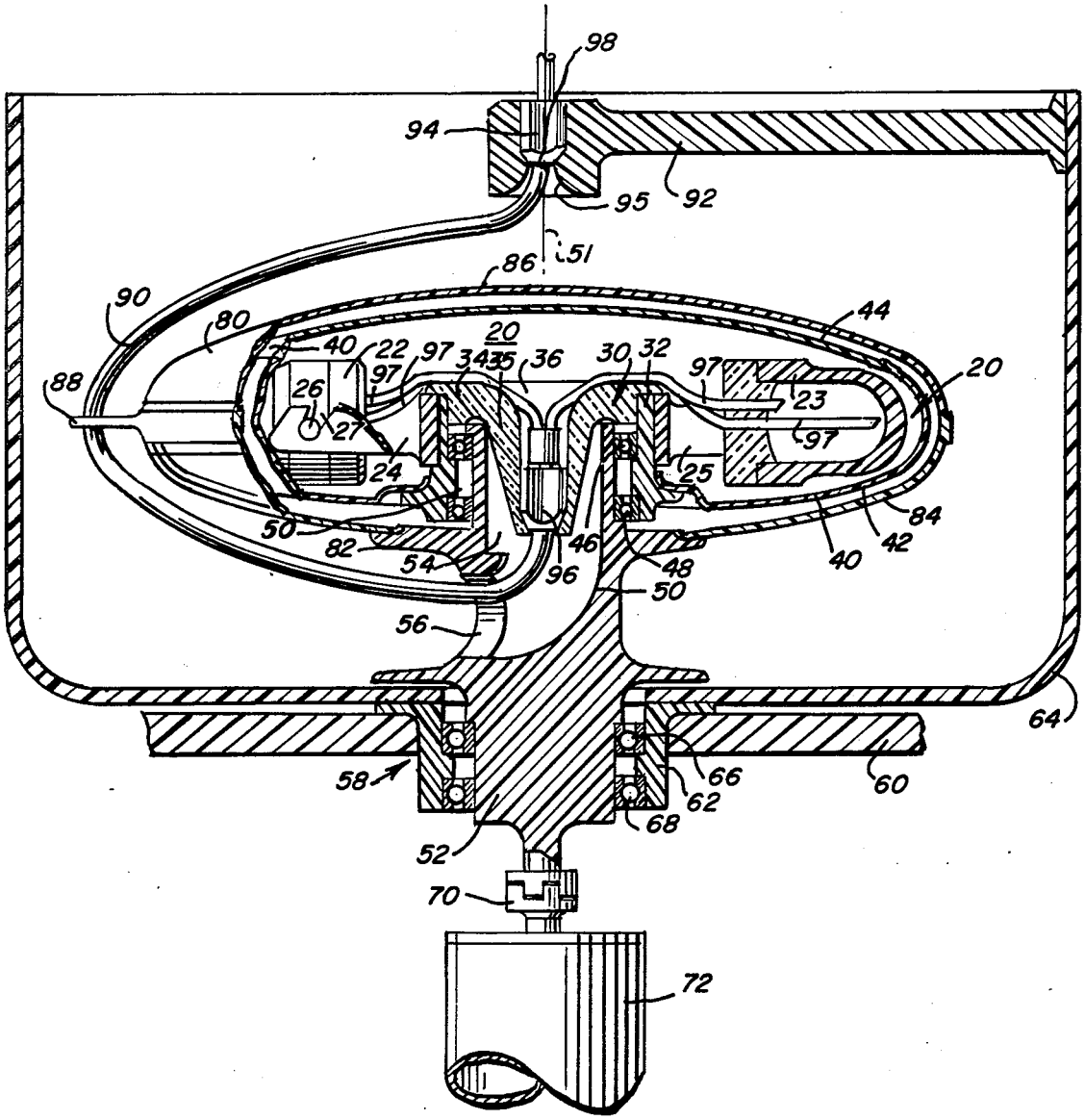
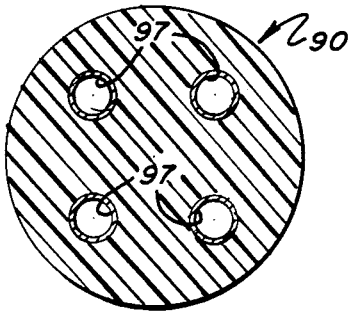
FIG. 2

CENTRIFUGAL PROCESSING APPARATUS USING TUBE DRIVE

BACKGROUND OF THE INVENTION

The present invention concerns a drive system for centrifugal processing apparatus.

Centrifugal processing systems are used in many fields. In one important field of use, a liquid having a suspended mass therein is subjected to centrifugal forces to obtain separation of the suspended mass.

As a more specific example, although no limitation is intended herein, in recent years the long term storage of human blood has been accomplished by separating out the plasma component of the blood and freezing the remaining blood cell component in a liquid medium, such as glycerol. Prior to use, the glycerolized red blood cells are thawed and pumped into the centrifugating wash chamber of a centrifugal liquid processing apparatus. While the red blood cells are being held in place by centrifugation, they are washed with a saline solution which displaces the glycerol preservative. The resulting reconstituted blood is then removed from the wash chamber and packaged for use.

The aforementioned blood conditioning process, like other processes wherein a liquid is caused to flow through a suspended mass under centrifugation, necessitates the transfer of solution into and out of the rotating wash chamber while the chamber is in motion. Thus while glycerolized red cell and saline solution are passed into the wash chamber, waste and reconstituted blood solutions are passed from the chamber. To avoid contamination of these solutions, or exposure of persons involved in the processing operation to the solutions, the transfer operations are preferably carried out within a sealed flow system.

One type of centrifugal processing system which is well adapted for the aforementioned blood conditioning process uses the principle of operation described in Dale A. Adams U.S. Pat. No. 3,586,413. The apparatus of the Adams patent establishes fluid communication between a rotating chamber and stationary reservoirs through a flexible interconnecting umbilical cord without the use of rotating seals, which are expensive to manufacture and which add the possibility of contamination of the fluid being processed.

The primary embodiment of the Adams patent comprises a rotating platform which is supported above a stationary surface by means of a rotating support. A tube is connected to the stationary support along the axis of the rotating platform and the rotating support, with the tube extending through the rotating support and having one end fastened to the axis of the rotating platform. A motor drive is provided to drive both the rotating platform and the rotating support in the same relative direction at speeds in the ratio of 2:1, respectively. It has been found that by maintaining this speed ratio, the tube will be prevented from becoming twisted. An improvement with respect to this principle of operation, comprising a novel drive system for a centrifugal liquid processing system, is disclosed in Khoja, et al. U.S. Pat. No. 3,986,442. In the Khoja, et al. patent, a novel drive system is provided for driving a rotor assembly at a first speed and a rotor drive assembly at one-half the first speed, in order to prevent an umbilical tube from becoming twisted.

While the Adams patent broadly suggests driving the rotating support to allow the tube to provide the necessary torque for driving the rotating platform, it has been discovered that this tube drive principle can be utilized with centrifugal processing apparatus by employing an umbilical tube formed of tubular material having a dynamic stiffness between 0.1 in.$^2$ pounds and 100 in.$^2$ pounds. In this manner, the processing chamber forms an idling member which does not require a direct drive by an external device or gears from the primary motor-shaft drive system.

Thus by using a stiff tubular material for the umbilical tube, the processing chamber will follow the driving rotation of such tube to automatically rotate at twice the speed of the tube. The advantage of a non-twisting tube will be maintained with the internal complexity of the centrifuge processing apparatus being significantly reduced. As a further result, the reduction in drive components greatly reduces cleaning requirements and simplifies the loading of software.

It is, therefore, an object of the present invention to provide centrifugal processing apparatus in which the processing chamber follows the driving rotation of an umbilical cable segment and thus requires no external direct drive mechanism.

A further object of the present invention is to provide a centrifugal processing apparatus which is simplified in construction and is efficient to manufacture.

Other objects and advantages of the present invention will become apparent as the description proceeds.

BRIEF DESCRIPTION OF THE INVENTION

In accordance with the present invention, centrifugal processing apparatus is provided in which a processing chamber is rotatably mounted with respect to a stationary base for rotation about a predetermined axis. An umbilical cable segment formed of tubular material having a dynamic stiffness of between 0.1 in.$^2$ pounds and 100 in.$^2$ pounds is provided for establishing fluid communication with the processing chamber. One end of the cable segment is fixed with respect to the base substantially along the axis at one side of the processing chamber. The other end of the cable segment is attached substantially on the axis in rotationally locked engagement to the processing chamber.

Means are provided for engaging and driving the cable segment. Means are provided for rotatably coupling the engaging and driving means to the processing chamber and means are provided for rotating the engaging and driving means to drive the cable segment at a selected speed.

The processing chamber forms an idling member which follows only the driving rotation of the cable segment to rotate at twice the speed of the cable segment without the need for any external drive.

In the illustrative embodiment, the rotating means comprises a shaft that is coaxial with the axis and the rotatably coupling means comprises bearing members which are connected to the shaft and to the processing chamber. The processing chamber includes a connection member concentrically positioned with respect to the shaft, with the bearing members connected to the shaft and the connection member.

In the illustrative embodiment, the engaging and driving means comprises an outer enclosure positioned about the processing chamber. The outer enclosure is symmetrically dimensioned about the predetermined axis and carries a projection member which extends radially outwardly therefrom for engaging the cable segment.

A more detailed explanation of the invention is provided in the following description and claims, and is illustrated in the accompanying drawings.

BRIEF DESCRIPTION OF THE DRAWINGS

FIG. 1 is a cross-sectional elevational view, partly in diagrammatic form and partially broken for clarity, showing a centrifugal apparatus constructed in accordance with the principles of the present invention; and FIG. 2 is a cross-sectional view of tubing used in connection with the apparatus of FIG. 1.

DETAILED DESCRIPTION OF THE ILLUSTRATIVE EMBODIMENT

Referring to FIG. 1, centrifugal processing apparatus is shown therein adapted for processing glycerolized red blood cells. It is to be understood, however, that the present invention is adaptable to use with various centrifugal processing apparatus, and the specific example given herein is merely for illustrative purposes.

The processing apparatus may include an outer cabinet (not shown) which may be suitably insulated and lined to permit refrigeration of its interior. Access to the interior may be provided by a hinged cover or the like and an external control panel (not shown) enables external control of the operation by an operator.

The red blood cell mass to be processed is subjected to centrifugal force in a processing chamber 20. Processing chamber 20 includes a pair of contoured support cups 22, 23, which are mounted in diametrically opposed positions on cradles 24, 25, respectively. A pin 26 and slot 27 arrangement is provided to allow easy attachment and removal of the support cups.

The cradles 24, 25 are rigidly fastened to a torque coupling connector 30 through a support ring 32. Connector 30 comprises an upper circular ring 34 with a downwardly extending body 35 having its external dimension tapering inwardly and defining a central axial bore 36.

Connector 30 is fastened to support ring 32 to which is fastened a bowl-shaped inner, or primary, enclosure 40. Enclosure 40 has a generally elliptical cross-sectional configuration and comprises a bottom portion 42 and a removable upper portion 44 which, when removed, provides access to the support cups 22, 23 and connector 30.

A pair of ball bearings 46, 48 are interposed between support ring 32, which forms a bearing housing, and a hollow central shaft 50 having a central axis 51. A shaft filler 52 is provided so that only the upper portion 54 of shaft 30 is hollow. Shaft 50 defines an opening 56 to permit a cable, which will be described below, to extend from the inside of the shaft to the outside thereof.

A stationary base 58 is provided including a fixed mounting plate 60 fastened to lower bearing housing ring 62. A bowl-shaped impact shield 64 is also fastened to lower bearing housing ring 62. A pair of ball bearings 66, 68 are interposed between lower bearing housing 62 and central shaft 50, thereby providing smooth relative rotation between the central shaft 50 and the stationary base 58.

Shaft 50 is rotated by means of direct coupling 70 which is driven directly by motor 72. While the simplicity of this direct coupling drive is apparent, other driving systems, e.g., using belts and pulleys, may be employed.

An outer enclosure 80 is fastened to an annular flange 82 extending from shaft 50. Outer enclosure 80 comprises a bottom portion 84 with an upper portion 86 removably fastened thereto. The outer enclosure 80 has a generally elliptical cross-sectional configuration, and is located concentrically with respect to the inner enclosure 40. Additionally, inner enclosure 40 and outer enclosure 80 are symmetrical with respect to connector 30, which connector is coaxial with shaft 50.

A drive pin 88 is fastened to outer enclosure 80 and extends outwardly radially therefrom, to engage the cable or tubing 90 in a driving relationship.

Fluid communication with the support cups 22 and 23, which rotate as part of processing chamber 20, and with the non-rotating portions of the centrifugal processing system, is provided by means of umbilical cable or tubing 90. Cable 90 defines separate passageways or conduits therein, with a cross-sectional view of cable 90 being illustrated in FIG. 2. Although cable 90 illustrated in FIG. 2 is four lumen tubing having the dimensions described below, it is to be understood that no limitation with respect to the particular size of the cable or the number of passageways is intended or should be implied. Further, tubing 90 could be circular or polygonal in cross-sectional configuration.

Cable 90 is suspended from a point above and axially aligned with processing chamber 20 by means of a stationary or fixed torque arm 92. Torque arm 92 is fastened to stationary impact shield 64. A collar 94, fastened to cable 90, is fixed to torque arm 92. A similar collar 96, fastened to cable 90, is fixed to body 35 of connector 30 within bore 36. Thus collars 94, 96, connector 30 and shaft 50 are substantially coaxial. The cable 90 carries four tubes 97 which extend to the interior of support cups 22, 23. A guide 95 is provided to aid in preventing the upper end of cable 90 from excessive radial extension at high speeds. Lubrication is provided to reduce frictional wear and heat.

In a preferred form, cable 90 defines four openings. Four tubes 97 are connected by bonding adjacent the ends of cable 90. In this manner there is no need to have tubes extending through the openings defined by cable 90.

It can be seen that a segment of cable 90 extends downwardly from an axially fixed position 98 at collar 94, extending radially outwardly, downwardly and around, on the outside of outer enclosure 80, and then radially inwardly and upwardly to collar 96 which rotates with the rotation of connector 30. It can be further seen that there is no direct drive for processing chamber 20 except that when motor 72 operates to rotate shaft 50, the rotation of drive pin 88 with shaft 50 will drive cable segment 90 to thereby turn collar 96 which is rigidly fixed to both cable 90 and connector 30, thereby rotating the support cups 22, 23 in the same direction of rotation as the shaft rotation.

It has been discovered that by using cable having a dynamic stiffness of between 0.1 in.$^2$ pounds to 100 in.$^2$ pounds, the cable is prevented from becoming twisted during rotation of shaft 50. Rotation of shaft 50 imparts rotation of cable 90 with a first angular velocity and the rotation of cable 90 imparts to processing chamber 20 a rotation thereof with an angular velocity of twice the first angular velocity. Thus for every 180° rotation of drive pin 88 and cable 90 the cable 90 will twirl 180° in one direction about its own axis, due to the fixed mount of the cable end at position 98. This twirl component, when added to the 180° rotation component, will result in the processing chamber 20 rotating 360°. Thus, umbilical cable 90 is subjected to cyclical flecture or bending during operation of the cell processing apparatus.

In order for the system to be operable at useful speeds, cable 90 must be capable of withstanding certain loads and stresses. For example, a significant load is carried by the tube at collars 94 and 96 due to the centrifugal force. This significant load must be sustained for a significant length of time, in order for the operation to be completed. Further, cable 90 undergoes cyclic bending stresses adjacent collars 94 and 96. This bending occurs many times per second and can create considerable heat due to mechanical loss with a resultant dimunition in physical properties. Thus the loss modulus of the tubing material must be sufficiently low so that the heat buildup is insignificant. Still further, in most cases cable 90 has some precurvature or "set" which results in a cyclic torsional loading. Contact of the cable 90 with drive pin 88 places additional torsional load on the cable. Thus the cable must have sufficient torsional rigidity to overcome the drag forces.

As stated above, it has been discovered that the cable 90 should have a dynamic stiffness of between 0.1 in. $^2$ pounds to 100 in. $^2$ pounds. The dynamic stiffness ("JG'") is defined as the polar moment of inertia about the centroidal axis ("J") times the dynamic modulas of torsional rigidity ("G'"), with G' also being known as the modulus of elasticity in shear. In order for proper operation to occur, the resilience of the cable should be such that the dynamic loss modulus in shear ("G'") is less than or equal to one-half G'. Still further, for optimum operation of the system cable 90 should have a diameter of between 0.25 inch and 0.50 inch.

As a specific example, there is illustrated in FIG. 2 cable having dimensions which have been found to be operable in the system. Referring to FIG. 2, cable 90 therein defines four passages each having a diameter of 0.11 inch with their centers being equidistantly spaced from each other 0.135 inch apart and with the outer diameter of the cable being 0.35 inch.

It has been found that a highly effective cable material is a polyester thermoplastic elastomer, particularly a polyester copolymer based on a poly(oxyalkylene), a dicarboxylic acid and a low molecular weight (i.e., short chain) diol. It is preferred that the dicarboxylic acid be aromatic, that the low molecular weight diol be 1,4-butanediol and that the poly(oxyalkylene) be poly(oxytetramethylene). A particularly suitable polyester elastomer is marketed by The DuPont Company under the registered trademark HYTREL, with a particularly suitable example of material useful for the tubing of the present invention being HYTREL © 5556 polyester elastomer. This material was found to have the mechanical properties which permit operation of the centrifugal processing apparatus disclosed herein, at high speeds for the processing chamber 20, such as 3,000 rpm.

By using an inner enclosure 40 having a generally bowl-shape and pa ticularly an elliptical cross-sectional configuration, and by using an outer enclosure 80 having a bowl-shape and particularly an elliptical cross-sectional configuration, the system is aerodynamically constructed to provide reduced wind resistance. In this manner, as a result of enclosures 40 and 80, the power required to be transmitted through the drive mechanism is reduced, thereby enabling the system to be constructed with smaller and less expensive driving components. Further, outer enclosure 80, which rotates at one-half the angular velocity of inner enclosure 40, is operable to prevent cable 90 from contacting the processing chamber. If cable 90 were not properly separated from the processing chamber, particularly at start-up, the cable may initially contact the processing chamber thereupon seizing the machine rotation. By utilizing outer enclosure 80, the angular velocity ratio of 1:2 is maintained. Still further, outer enclosure 80 aids to absorb some of the impact in the event that a component of or within the processing chamber 20 failed and was expelled.

Although an illustrative embodiment of the invention has been shown and described, it is to be understood that various modifications and substitutions may be made by those skilled in the art without departing from the novel spirit and scope of the present invention.

What is claimed is:

1. Centrifugal processing apparatus, which comprises:

a stationary base;

a processing chamber rotatably mounted with respect to said base for rotation about a predetermined axis;

an umbilical cable segment formed of tubular material having a dynamic stiffness of between 0.1 in. $^2$ pounds and 100 in. $^2$ pounds for establishing fluid communication with said processing chamber, one end of said cable segment being fixed with respect to said base substantially along said axis at one side of said processing chamber, the other end of said cable segment being attached substantially on said axis in rotationally locked engagement to said processing chamber;

means for engaging and driving said cable segment;

means rotatably coupling said engaging and driving means to said processing chamber;

means for rotating said engaging and driving means to drive said cable segment at a selected speed; and said processing chamber forming an idling member which follows only the driving rotation of said cable segment to rotate at twice the speed of said cable segment without the need for any external drive.

2. Centrifugal processing apparatus as described in claim 1, said rotating means comprising a shaft that is coaxial with said axis; and said rotatably coupling means comprising bearing members connected to said shaft and to said processing chamber; and motor drive means for directly rotating said shaft.

3. Centrifugal processing apparatus as described in claim 2, said processing chamber including a connection member concentrically positioned with respect to said shaft, with said bearing members connected to said shaft and said connection member; means attaching said cable segment to said connection member.

4. Centrifugal processing apparatus as described in claim 2, including bearings connected to said stationary base and said shaft for providing rotational support for said base and shaft.

5. Centrifugal processing apparatus as described in claim 1, said engaging and driving means comprising an outer enclosure positioned about said processing chamber and being symmetrically dimensioned about said axis, said outer enclosure carrying a projecting member which extends radially outwardly therefrom for engaging said cable segment.

6. Centrifugal processing apparatus, which comprises:

a main drive shaft;

a stationary base concentrically positioned about said drive shaft;

bearing members connecting said stationary base to said shaft to permit relative rotation of said shaft and stationary base;

a motor for driving said shaft;

a processing chamber positioned for coaxial rotation with said shaft, said processing chamber including a connection member concentrically positioned with respect to said shaft;

bearing members connecting said connection member to said shaft to permit relative rotation of said connection member and said shaft;

an umbilical cable segment formed of tubular material having a dynamic stiffness of between 0.1 in. $^2$ pounds and 100 in. $^2$ pounds for establishing fluid communication with said processing chamber, said tubular material having a resilience such that the dynamic loss modulus in shear is no greater than one-half the dynamic modulus of torsional rigidity, one end of said cable segment being fixed with respect to said base substantially along said axis at one side of said processing chamber, the other end of said cable segment being attached substantially on said axis in rotationally locked engagement to said processing chamber;

means attached to said shaft for driving said cable segment; and said processing chamber forming an idling member which follows only the driving rotation of said cable segment to rotate at twice the speed of said cable segment without the need for any external drive.

7. Centrifugal processing apparatus as described in claim 6, said driving means comprising an outer enclosure positioned about said processing chamber and being symmetrically dimensioned about said axis, said outer enclosure carrying a projecting member which extends radially outwardly therefrom for engaging said cable segment.

* * * * *